United States Patent [19]

Luderer et al.

[11] 4,159,082

[45] Jun. 26, 1979

[54] SPRAY GUN

[75] Inventors: Manfred Luderer, Leutenbach; Karl Rapp, Winnenden-Bürg; Rolf Schneider, Burgstetten-Burgstall, all of Fed. Rep. of Germany

[73] Assignee: Firma Ernst Mueller KG, Winnenden, Fed. Rep. of Germany

[21] Appl. No.: 841,300

[22] Filed: Oct. 12, 1977

[30] Foreign Application Priority Data

Oct. 25, 1976 [DE] Fed. Rep. of Germany ..... 2646719

[51] Int. Cl.[2] ..... B05B 7/12

[52] U.S. Cl. ..... 239/407; 239/412; 239/417.5

[58] Field of Search ..... 239/407, 412, 413, 416.1, 239/416.4, 416.5, 417.3, 417.5, 418, 423, 426

[56] References Cited

U.S. PATENT DOCUMENTS 3,135,467 6/1964 Greenman ..... 239/417.5

3,201,048 8/1965 Gibbs ..... 239/412

*Primary Examiner*—James B. Marbert

*Attorney, Agent, or Firm*—Burns, Doane, Swecker & Mathis

[57] ABSTRACT

A spray gun includes several atomizer and a plurality of conduits communicating therewith for supplying different coating materials. A valve needle is disposed in each supply conduit, such needles being individually controlled by pneumatic cylinders. In one embodiment the supply conduits are oriented at an acute angle relative to the axis of the gun barrel. In a second embodiment the supply conduits curve away from such longitudinal axis, with the valve needles formed of elastic material. In a third embodiment the supply conduits extend parallel to the longitudinal axis of the barrel, with the pneumatic cylinder oriented at a right angle relative to the valve needle and connected thereto by means of a knee joint.

12 Claims, 3 Drawing Figures

SPRAY GUN

Figure 1:
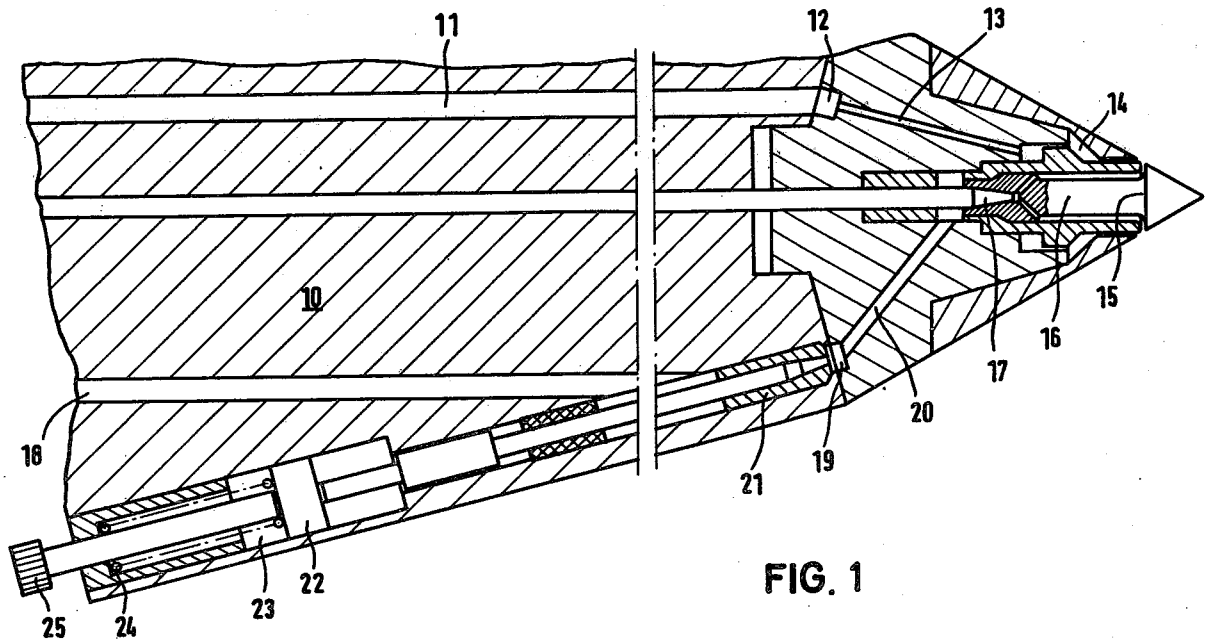

The invention concerns a spray gun for the purpose of atomizing and applying selectively coating materials of diverse composition in powder or liquid form, especially varnishes of diverse color. The spray gun is of the type comprising several conduits for the supply of the various coating materials, an annular channel located within a plane running vertically to the longitudinal axis of the gun barrel, with all supply conduits leading into said channel, a relatively short feeding channel which extends in the direction of the longitudinal axis of the gun barrel and which is in communication with the annular channel by a connecting conduit, and finally an atomizer which is centrally located at the free end of the gun barrel and which is supplied by the feeding channel, with needle valves placed in the frontal parts of the supply conduits, the valve needles being individually controlled by pneumatically operating cylinders.

A spray gun of the above described type, employing a so-called color alternator, is shown by the published German application No. 1 546 838. The apparatus disclosed there utilizes four supply conduits, with three conduits supplying varnishes of diverse colors while the fourth conduit supplies a cleansing agent. The needle valves of the supply conduits are located near their outlet end, the annular channel has a relatively small diameter and the central feeding channel is relatively short, in other words, the outlets of the supply conduits for the atomizer nozzle are in close proximity to each other, so that the losses of varnish cleansing occur during color switches will not be excessive. Such losses of varnish are incurred because it is necessary in case of a color change to remove the varnish of the previously sprayed color which is present in the annular channel, in the conduit leading to the supply conduit and in the supply conduit proper prior to the spraying with varnish of the new color. The removal of the remainder of the previously sprayed varnish is accomplished either by the varnish of the new color or by a special cleaning agent, the latter method being employed most of the time. However, in case of the known arrangement these losses of varnish are relatively minor due to the small profile of the supply channels between the needle valves of the individual supply conduits and the atomizer nozzle.

Spray guns with color alternator are widely used by the automotive industry. However, factories producing automobiles normally offer broad color sections so that spray guns which are components of automated systems must be equipped with 15 to 25 supply conduits. If the attempt is made to provide the spray gun shown by DT-OS No. 1 546 838 with 20 supply conduits in place of the 4 conduits disclosed there, a great number of difficulties will be encountered. It will become necessary to increase the diameter of the annular channel significantly to make allowance for the junction of 20 supply conduits. If the supply conduits, together with the axially following operating cylinders, run parallel to the longitudinal axis of the gun barrel, as shown in the DT-OS, the individual supply conduits must not be located very close to each other because it would then be difficult to accomodate and to service the operating cylinders, so that the diameter of the annular channel must be made very large indeed. If the attempt is made to reduce the length of the central channel feeding the atomizer nozzle for the purpose of reducing the losses of varnish, as discussed above, the design would lead to the presence of a wide bulge directly in back of the atomizer nozzle. The generally known consequence of such design would be the fact that the spray produced by the atomizer nozzle will be unsatisfactory because the low-pressure zones which are created around the atomizer nozzle by compressed-air guns as well as by high-pressure guns not using compressed air will not be resupplied any longer uniformly by atmospheric air which is drawn from the surrounding area by gun barrels of narrow diameters. Tests have definitely shown that in the case of the presence of bodies in back of the atomizer nozzle which extend widely across the direction of the spraying there are being generated air turbulences which will lead to a substantially impaired spray effect. This holds also, and especially, true if the spraying is performed by the application of an electrostatic high-tension field. The same difficulties will arise if the supply conduits, together with the successively arranged operating cylinders, are placed within a plane vertically to the longitudinal axis of the gun barrel, in other words, if the supply conduits end at the annular duct in radial form. Obviously, here again the rate of flow will be greatly impeded. For this reason, the central channel feeding the atomizer nozzle has in practice been extended in length quite substantially whenever a great number of supply conduits were needed in order to attain a proper distance between atomizer nozzle and the annular channel unit. Most of the commercially available devices of this type even use a long hose to connect the atomizer nozzle with the annular channel. This method makes it possible to produce color-alternating spray guns with a great number of supply conduits, approximately up to 25 conduits, without adverse influence on the rate of flow, and thus on the efficiency of the spray output. On the other hand, this method involves greater losses of varnish when the color is being changed, due to the larger diameter of the annular channel and the long channel leading to the atomizer nozzle. These losses of varnish are very uneconomical. It should be realized that an automated system as used by the automotive industry contains 10 to 20 color spray guns, that the residual amount of varnish is removed—unprofitably—by a cleansing agent after each working cycle due to the particular programming of the automated system, whether or not a color change will actually take place, and finally that every day hundreds of working cycles will occur; computations will show that in case of varnish residues of 10 to 20 $cm^3$ per working cycle, the costs of the quantity of varnish wasted throughout one year will be in the order of several hundred thousand German Marks.

It is therefore the aim of the invention to produce a spray gun with so-called color alternator of the above defined type which even in case of the presence of a great number—at least eight—of supply conduits will cause only minor losses of varnish per color change, and without detrimental effect on the flow-engineering requisites of the spray gun.

The invention offers three alternatives, solving the problem first in that manner that the supply conduits with their frontal parts, surrounding the valve needles, and with the operating cylinders, arranged successively and axially to the valve needles, are forming an acute angle with the longitudinal axis of the gun barrel thusly that the body, comprising gun barrel, supply conduits and operating cylinders, tapers off conically toward the atomizer. This arrangement makes it possible, even in the presence of a great number of supply conduits, to keep the diameter of the annular channel relatively small and the central channel feeding the atomizer nozzle relatively short, so that the supply conduits will discharge immediately behind the atomizer without causing any flow-engineering difficulties. The conical design of the structural unit will even improve the flow conditions.

The invention solves the problem secondly in that manner that the frontal parts of the supply conduits surrounding the valve needles are curved thusly that the supply conduits, beginning at the junction with the annular channel, will first run parallel with the longitudinal axis of the gun barrel and then move away from the gun barrel into a position substantially vertical to the longitudinal axis of the gun barrel, that the valve needles consist of elastic material and are curved in conformity with the supply conduits, and that the operating cylinders, arranged successively and axially to the valve needles, are placed within a plane substantially vertical to the longitudinal axis of the gun barrel. This arrangement, like the first solution, makes it possible to place the outlets of the supply conduits, and thus the annular channel, in close proximity to the atomizer nozzle while keeping down the dimensions of the frontal section of the gun barrel containing the supply conduits; a uniform widening will take place at a considerable distance from the atomizer nozzle only, resulting from the curving of the supply conduits.

Finally, the problem can be solved in that manner that the valve needles and their operating cylinders are placed vertically to each other, being connected with each other by knee joints, whereby the supply conduits and the valve needles extend, in a manner known per se, parallel to the longitudinal axis of the gun barrel while the operating cylinders are placed in a plane running vertically thereto. This solution is particularly suitable if there is no need for a very great number of supply conduits, that is if only 10 to 15 such conduits are involved.

The several species of the invention are illustrated by drawing.

Figure 2:
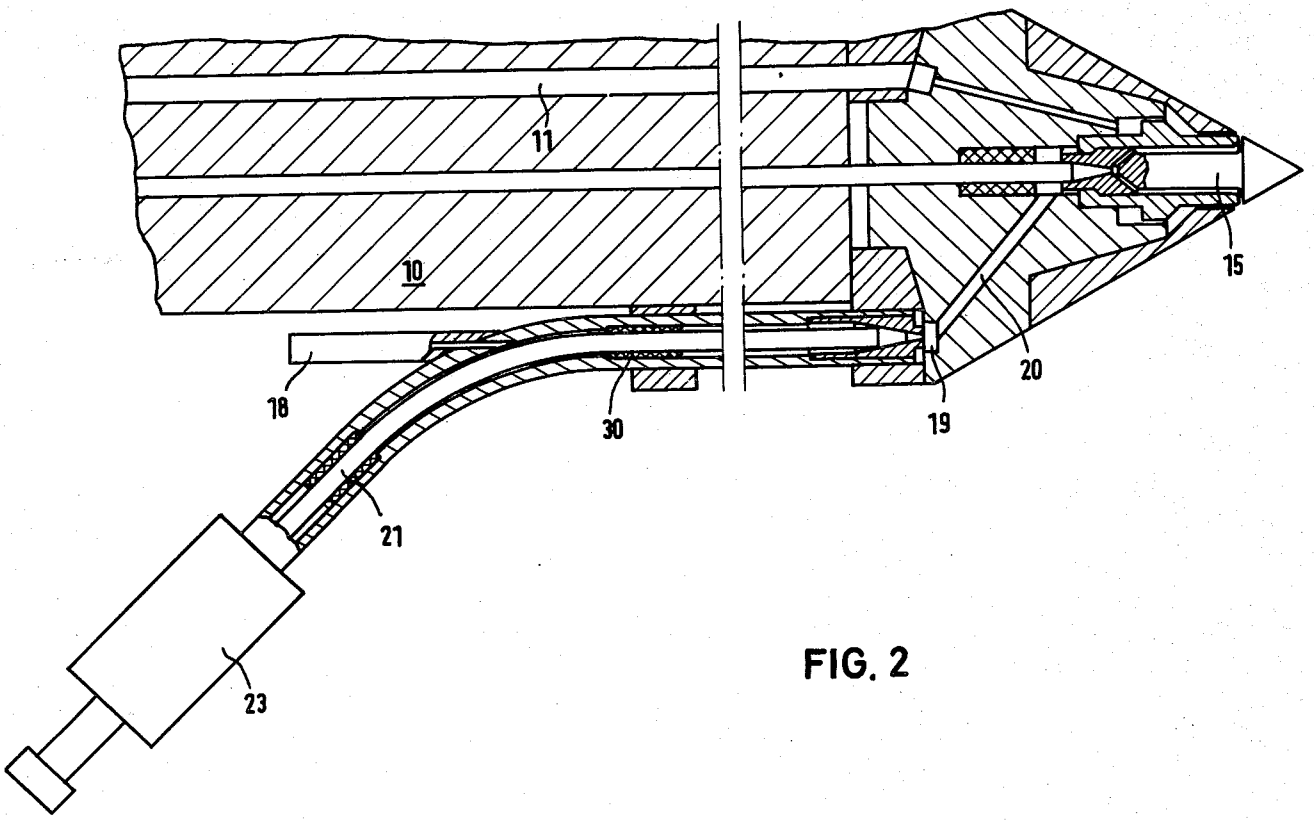
Figure 3:
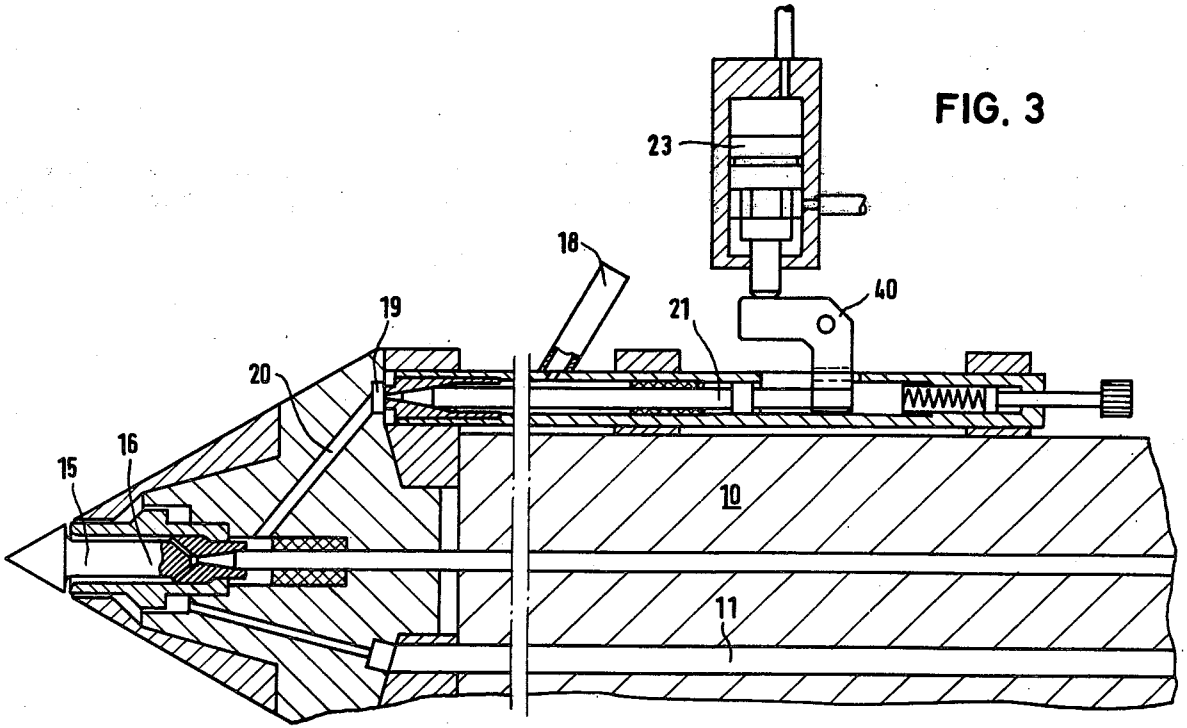

FIG. 1 gives a sectional view of the frontal area of a spray gun in accordance with the first solution offered by the invention, FIG. 2 gives a sectional view of the frontal area of a spray gun in accordance with the second solution offered by the invention, and FIG. 3 gives a sectional view of the frontal area of a spray gun in accordance with the third solution offered by the invention.

FIG. 1 shows the frontal area of the gun barrel 10 of a color spray gun with pneumatic atomization. The gun barrel 10 has a duct 11 for the atomizer air, supplying this air to an air nozzle 14 by way of an annular air duct 12 and a conduit 13. The air nozzle 14 surrounds concentrically the central color nozzle 15, fed by an axial supply channel 16 which contains a central valve with valve needle 17. Numeral 18 denotes the supply conduits (only one depicted) for varnishes of diverse colors, or for a cleansing agent respectively. The supply conduits 18 end at an annular channel 19 which is connected with the supply channel 16 by way of connecting conduit 20. Numeral 21 denotes valve needles (only one depicted) which are located at the discharge end of the conduit 18 and which are operated by pistons 22, the pistons sliding within pneumatically operating cylinders 23. Numeral 24 denotes lock springs and numeral 25 set screws.

At every working cycle one of the operating cylinders 23 will pull back one of the color needles 21, thus allowing the varnish of the appropriate supply conduit 18 to enter the annular channel 19, and from there to reach the atomizer nozzle 15 by way of the connecting conduit 20, the open central valve 17 and the supply channel 16. If the color is to be changed, the open color valve is closed, and the valve of one of the conduits 18 which is connected to a supply of cleansing agent is then opened and the varnish residue, which is still present in the annular channel 19, the connecting conduit 20 and the supply channel 16, is forced out by the cleansing agent, the valve of the cleansing agent supply conduit is closed and the valve of another supply conduit, carrying the desired varnish color, is opened and the spray gun is ready for the next process.

The drawing shows that the structural unit, comprising the discharge area of the supply conduits 18, the valve needles 21 and the operating cylinders 23, has an incidence relative to the longitudinal axis of the gun barrel or respectively forms an acute angle with the same. The front part of the gun barrel and the components mentioned thus forms a cone which tapers off conically in direction of the atomizer nozzle 15. The angle of incidence is preferably smaller than 30°. In case of the species illustrated, approximately 15 to 25 supply conduits 18, each carrying a set of valves 21, 22, 23, can be accommodated, with the volume of annular channel 19, connecting conduit 20 and supply channel 16 amounting to no more than 3 $cm^3$. In other words, even if 25 supply conduits 18 are being used, the varnish losses will amount only to 3 $cm^3$ for each color change, that is 30% only of the losses incurred by conventional spray guns of this type. Furthermore, the spray gun illustrated creates favorable flow conditions which means that the atomization at the nozzle 15 is being accomplished in a very effective manner without the appearance of air turbulences.

The presence of an additional central valve 17 has the advantageous result, that a blockage of the nozzle 15 by drying varnish will be eliminated. However, the central valve can be omitted if this is desired since every supply conduit 18 is equipped with an individual valve.

FIG. 2 shows a second solution as proposed by the invention, with like components denoted by like reference numerals. The drawing indicates that the discharge section of the supply conduits 18 runs parallel to the longitudinal axis of the gun barrel, curving outwardly and away from the gun barrel 10 only at a considerable distance from the atomizer nozzle 15 so that the pneumatically operating cylinders 23 are at a distance from the gun barrel 10 and extend substantially within a plane vertically to the longitudinal axis of the gun barrel. The valve needles 21 are curved and are supported by needle guides 30. The needles 21 are relatively long and consist of elastic material, preferably a synthetic material. This arrangement has substantially the same effect as the arrangement shown by FIG. 1, which means that it can accommodate approximately 15 to 25 supply conduits 18, and that the varnish losses will again be approximately 3 $cm^3$. Tests have shown that the valve needles 21, in spite of their considerable length and their flexibility will operate satisfactorily.

Finally, FIG. 3 depicts a third arrangement proposed by the invention where again like components are denoted by like reference numerals. In case of this species the discharge sections of the supply conduits 18 with their valve needles 21 run parallel to the longitudinal axis of the gun barrel while the operating cylinders 23 are arranged in a plane vertically to the longitudinal axis of the gun barrel and are connected with the needles 21 by knee joints 40. The needles 21 have again, as in case of the species shown by FIG. 2, a considerable length but are not curved. This arrangement proposed by the invention has substantially the same effect as the arrangement shown by FIG. 1 but is more suitable for systems using a smaller number of supply conduits 18, that is approximately 10 to 15 conduits.

Obviously, the invention is not limited to spray guns operating with atomizing air but is also advantageously applicable to guns which operate without air pressure. It will be particularly advantageous to utilize the invention in connection with spray guns which operate by means of an electrostatic field because the avoidance of air turbulences is of great importance here.

We claim:

1. In a spray gun to atomize and apply selectively coating materials of diverse composition in powder or liquid form, especially varnishes of diverse color, comprising a barrel, several conduits for the supply of the various coating materials, an annular channel located within a plane extending vertically to the longitudinal axis of the gun barrel and with all supply conduits leading into said channel, a relatively short supply channel which extends in the direction of the longitudinal axis of the gun barrel and which is in communication with the annular channel by a connecting conduit, an atomizer which is located centrally at the free end of the gun barrel and which is fed by the supply channel, and needle valves placed in the frontal sections of the supply conduits, the valve needles individually controlled by pneumatically operating cylinders, the improvement wherein the frontal sections of the supply conduits surround the associated valve needles and the operating cylinders are arranged successively and axially to the valve needles, said supply-conduits forming an actute angle with the longitudinal axis of the gun barrel so that the gun barrel so that the gun barrel, the supply conduits and the operating cylinders form a member which tapers off conically toward the atomizer.

2. In a spray gun to atomize and apply selectively coating materials of diverse composition in powder or liquid form, especially varnishes of diverse color, comprising a barrel, several conduits for the supply of the various coating materials, an annular channel located within a plane extending vertically to the longitudinal axis of the gun barrel and with all supply conduits leading into said channel, a relatively short supply channel which extends in the direction of the longitudinal axis of the gun barrel and which is in communication with the annular channel by a connecting conduit, an atomizer which is located centrally at the free end of the gun barrel and which is fed by the supply channel, and needle valves placed in the frontal sections of the supply conduits, the valve needles individually controlled by pneumatically operating cylinders, the improvement wherein the frontal sections of the supply conduits surround the valve needles are curved so that the supply conduits, beginning at the junction with the annular channel, first run parallel with the longitudinal axis of the gun barrel and then move away from the gun barrel into a position substantially vertical to the longitudinal axis of the gun barrel, the valve needles comprise elastic material and are curved in conformity with the supply conduits, and the operating cylinders arranged successively and axially to the valve needles are placed within a plane substantially vertical to the longitudinal axis of the gun barrel.

3. In a spray gun to atomize and apply selectively coating materials of diverse composition in powder or liquid form, especially varnishes of diverse color, comprising a barrel, several conduits for the supply of the various coating materials, an annular channel located within a plane extending vertically to the longitudinal axis of the gun barrel, and with all supply conduits leading into said channel, a relatively short supply channel which extends in the direction of the longitudinal axis of the gun barrel and which is in communication with the annular channel by means of a connecting conduit, an atomizer which is located centrally at the free end of the gun barrel and which is fed by the supply channel, and needle valves placed in the frontal sections of the supply conduits, the valve needles individually controlled by pneumatically operating cylinders, the improvement wherein the valve needles and their operating cylinders are oriented at right angles relative to each other and are connected with each other by knee joints, with the frontal sections of the supply conduits and the valve needles extending parallel to the longitudinal axis of the gun barrel, while the operating cylinders lie in a plane vertical thereto.

4. Spray gun as defined in claim 1, where said acute angle is smaller than 30°.

5. Spray gun as defined in claim 2, where the valve needles comprise a synthetic material.

6. Spray gun as defined in claim 3, where the knee joints engage the end of the valve needles that is remote from the valve seat.

7. Spray gun as defined in claim 1, where there are provided 10 to 25 supply conduits and the total volume of the annular channel, connecting conduits and central supply channel is less than 3 $cm^3$.

8. Spray gun as defined in claim 1, where a central valve is placed in the central supply channel.

9. Spray gun as defined in claim 2, where there are provided 10 to 25 supply conduits and the total volume of the annular channel, connecting conduit and central supply channel is less than 3 $cm^3$.

10. Spray gun as defined in claim 3, where there are provided 10 to 25 supply conduits and the total volume of the annular channel, connecting conduits and central supply channel is less than 3 $cm^3$.

11. Spray gun as defined in claim 2, where a central valve is placed in the central supply channel.

12. Spray gun as defined in claim 3, where a central valve is placed in the central supply channel.

* * * * *